US008376346B2

(12) United States Patent
Roth et al.

(10) Patent No.: US 8,376,346 B2
(45) Date of Patent: Feb. 19, 2013

(54) DEVICE AND METHOD FOR PRODUCING STACKS COMPOSED OF PRINTED SHEETS

(75) Inventors: André Roth, Zofingen (CH); Erwin Von Aesch, Oftringen (CH)

(73) Assignee: Mueller Martini Holding AG, Hergiswil (CH)

( * ) Notice: Subject to any disclaimer, the term of this patent is extended or adjusted under 35 U.S.C. 154(b) by 526 days.

(21) Appl. No.: 12/549,660

(22) Filed: Aug. 28, 2009

(65) Prior Publication Data

US 2010/0050572 A1 Mar. 4, 2010

(30) Foreign Application Priority Data

Aug. 29, 2008 (EP) ..... 08405208

(51) Int. Cl.
*B65B 13/00* (2006.01)
*B65B 63/02* (2006.01)

(52) U.S. Cl. ..... 270/58.07; 53/542; 198/418.8

(58) Field of Classification Search ..... 270/58.07; 53/399, 436, 528, 531, 542; 414/790.2; 198/418.8
See application file for complete search history.

(56) References Cited

U.S. PATENT DOCUMENTS

| | | | | |
|---|---|---|---|---|
| 5,358,232 | A | 10/1994 | Arendes et al. | |
| 6,782,678 | B1 * | 8/2004 | Bodereau | 53/542 |
| 7,200,976 | B2 * | 4/2007 | Gosslinghoff | 53/399 |
| 7,677,545 | B2 * | 3/2010 | Iwami et al. | 271/3.01 |
| 7,862,020 | B2 * | 1/2011 | Haller et al. | 270/52.16 |
| 2004/0065214 | A1 | 4/2004 | Muri et al. | |
| 2007/0187886 | A1 * | 8/2007 | Haller et al. | 271/176 |
| 2008/0230981 | A1 * | 9/2008 | Iwami et al. | 271/153 |

FOREIGN PATENT DOCUMENTS

| | | | |
|---|---|---|---|
| EP | 0 623 542 | A1 | 7/1994 |
| EP | 0 847 949 | A1 | 6/1998 |
| EP | 0 872 443 | A2 | 10/1998 |
| EP | 1 405 809 | A1 | 4/2004 |
| WO | WO-2004/009448 | A1 | 1/2004 |

OTHER PUBLICATIONS

European Search Report dated May 3, 2009, issued in related European Patent Application No. 08405208.3, and its English-language translation.

Office Action from the State Intellectual Property Office of P.R. China issued in Chinese Application No. 200910170614.3 dated Sep. 5, 2012.

* cited by examiner

*Primary Examiner* — Leslie A Nicholson, III
(74) *Attorney, Agent, or Firm* — Venable LLP; Robert Kinberg

(57) ABSTRACT

A method for producing stacks of printed sheets, including supplying the printed sheets along a conveyor, stacking the printed sheets along the stack support in an upright position, supporting the first stack via a supporting device, transferring the first stack from the supporting device to a compression device having first and second compression carriages, compressing the first stack between the first and second compression carriages, strapping the first stack, releasing and moving the first compression carriage towards a second stack subsequently formed, and transferring support for the second stack from the supporting device to the first compression carriage.

8 Claims, 11 Drawing Sheets

DEVICE AND METHOD FOR PRODUCING STACKS COMPOSED OF PRINTED SHEETS

CROSS-REFERENCE TO RELATED APPLICATION

This application claims the priority of European Patent Document No. 08405208.3, filed on Aug. 29, 2008, the subject matter of which is incorporated herein by reference.

BACKGROUND OF THE INVENTION

The application relates generally to a method, and corresponding device, for producing stacks composed of printed sheets.

Methods for producing stacks have high requirements with respect to cycle time and reliability to be able to process the supplied number of printed sheets. The cycle time should be as short as possible without reducing the reliability.

The European Patent Document EP-A-1 405 809 discloses an apparatus with a supporting device that is provided with a third support element for shortening the cycle time, wherein this support element can be raised and is assigned to the front end of the stack in the stack conveying direction. The third support element can be operated with guidance along the stack support, independent of a first and a second support element, thus resulting in more freedom of handling and a higher production capacity. The supporting device also functions as device for separating a following stack. This apparatus has the disadvantage of having a comparatively complex design for the supporting or separating device.

SUMMARY

It is an object of the present invention to create a method and a device, which may permit a more cost-effective operation along with a shorter cycle time. The above and other objects are accomplished according to one aspect of the invention wherein there is provided a method for producing stacks of printed sheets which, in one embodiment, includes supplying the printed sheets along a conveyor to a horizontally extending stack support; stacking the printed sheets along the stack support in an upright position to form a first stack having a first end positioned towards the conveyor and a second end positioned away from the conveyor; supporting the first stack via a supporting device positioned at the second end of the first stack; transferring the first stack from the supporting device to a compression device having first and second compression carriages; compressing the first stack between the first and second compression carriages; strapping the first stack; releasing and moving the first compression carriage towards a second stack subsequently formed along the stack support and supported by the supporting device; and transferring support for the second stack from the supporting device to the first compression carriage at the second end of the second stack.

In a further embodiment, once a compressed stack is strapped, the first compression carriage may be moved toward a following stack that forms on the stack support and may take over the support of this stack from the supporting device on the stack side that is facing away from the conveyor. The supporting device may thus be freed immediately and can be used once more for separating the stack. As a result, it may be possible to achieve a shorter cycle time without a considerably higher structural expenditure. The supporting device can have a comparatively simple design and need not require a third support element. The time saved during each cycle may be considerable, especially when producing comparatively short stack packets or bundles.

According to another embodiment, once the strapped stack is discharged from the device, the second compression carriage may also be moved to the additional stack that forms and takes over the support of said stack from the first compression carriage. The first compression carriage therefore may only temporarily support the forming stack. Following the takeover by the second compression carriage, the first compression carriage, which is now freed up, may be moved to the additional stack side facing the conveyor where it may take over the supporting function from the supporting device.

According to another embodiment, the first compression carriage may be provided with at least one support element, which may support the additional stack on the side facing away from the conveyor and may move it from an outer to an inner position for the supporting function. As soon as the forming stack is supported on the side facing away from the conveyor by the second compression carriage, the support element may again be moved back to its outer, or pulled back, position. For example, the at least one support element may be moved essentially transverse to the stack conveying direction while moving between its inner and outer position.

The application furthermore relates to a device for producing stacks of printed sheets which, according to one embodiment, includes a conveyor that conveys printed sheets; a horizontally extending stack support that receives the printed sheets from the conveyor supplied continuously in an upright position; a supporting device that forms a stack on the stack support, wherein the stack includes a first end positioned towards the conveyor and a second end positioned away from the conveyor; and a compression device that receives and compresses a completed stack from the supporting device, wherein the compression device comprises a first compression carriage and a second compression carriage between which a completed stack is compressed, and wherein the first compression carriage is adaptable to fit the second end of the stack to be compressed and includes at least one support element to support a forming stack on the second end.

Such a device may be suitable for realizing the aforementioned method and allowing the forming of stacks composed of printed sheets during an especially short cycle time. The device may be comparatively cheap to produce, but is nevertheless reliable.

According to a further embodiment, the first compression carriage may be provided with two compression members that respectively may have one back side facing away from the conveyor, which may be designed for the compressing of a stack formed on the stack support. These compression members may be arranged at a distance to each other and can be moved transverse to the stack conveying direction. The spacing between the compression members can thus be adapted easily to the format of the printed sheets or to the stack width.

In another embodiment, the support elements may be arranged on at least one of the two compression members, on the side facing the conveyor. As a result, the support elements can be adjusted together with the compression members in a direction transverse to the stack conveying direction. One support element may be arranged on each compression element, wherein these support elements can be moved between an inner and an outer position. In the outer position, the support elements may not restrict the space between the compression members. Comparatively wide stacks can thus also be formed, such as dual use stacks which may include two identical products that may be produced while joined and may be separated only during a subsequent processing step.

The support elements can be embodied, for example, as yokes, plates, or the like and can be displaced between the two positions by pivoting them, pushing them or the like. The support elements may be operated with a positioning cylinder, wherein the use of other drive devices is conceivable as well.

BRIEF DESCRIPTION OF THE DRAWINGS

The present invention will be more readily understood from the following detailed description when read in conjunction with the accompanying drawings, in which.

DETAILED DESCRIPTION

Figure 1:
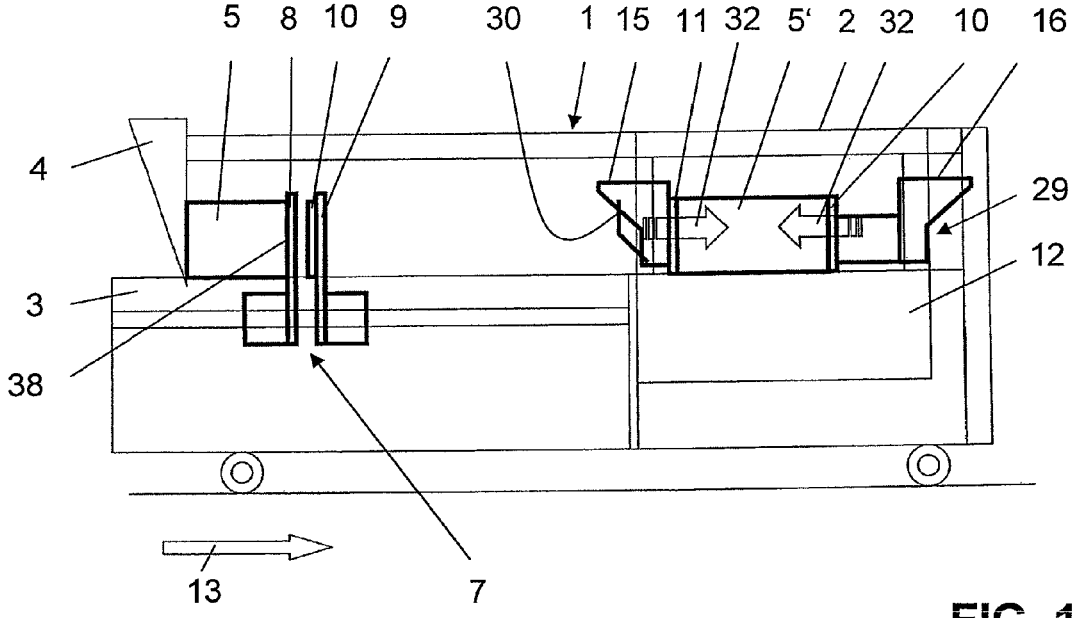
FIGS. 1-7 are schematic views from the side of the device according to the invention during different phases of a processing cycle.

Referring to FIG. 1, the device 1 can comprise a machine frame 2 with a stack support 3 that extends in horizontal direction. The stack support 3 is supplied by a conveyor 4 with printed sheets 6 (FIG. 8), conveyed substantially vertically from above in an overlapping flow. These types of conveyors 4, e.g. consisting of two belts, for conveying overlapping flows are disclosed in the art and need not be explained further herein. A continuously growing stack 5 is formed with the supplied printed sheets 6 on the stack support 3, wherein this stack has one stack side 39 that is facing toward, and one stack side 38 that is facing away from the conveyor 4 (see FIG. 3). According to FIG. 1, the stack 5 is supported on the side 38 that is facing away from the conveyor 4 by a first support and separating element 8 of a supporting device 7. The supporting device 7 is provided with a second support and separating element 9, which serves to move a first end plate 10, previously inserted in a manner disclosed in the art into the stack support 3, toward the stack 5. By supplying additional printed sheets 6 to the stack support 3, the stack side 38 moves to the right inside a stack conveying device, as represented by arrow 13. Accordingly, the supporting device 7 is also moved to the right, at least at times, during the forming of the stack 5.

The device 1 furthermore comprises a compression device 29 that is provided with a first compression carriage 15 and a second compression carriage 16. The two compression carriages 15 and 16 can be moved in stack conveying direction 13 as well as counter thereto. A stack 5 that is formed as described in the above can be compressed in a following method step between the two compression carriages 15 and 16, meaning the air cushions between the individual printed sheets 6 are essentially pressed out and the stack 5 is compacted in this way. The aforementioned first end plate 10 is thus moved against the stack side 38 that is facing away from the conveyor 4 while a second end plate 11 is moved against the stack side 39 that is facing the conveyor 4, wherein these end plates can be made of wood. The arrows 32 shown on the right side in FIG. 1 indicate the direction of the forces used to compress a previously formed stack 5 into a stack 5'. A strapping device 12, arranged in this region of the device 1 and disclosed in the art, is used to strap the compressed stack 5'. The manner in which the stack 5' is strapped and thus stabilized is not essential to the embodiment. It is only important that the compressed stack 5' can be transported securely to a following processing station.

Figure 2:
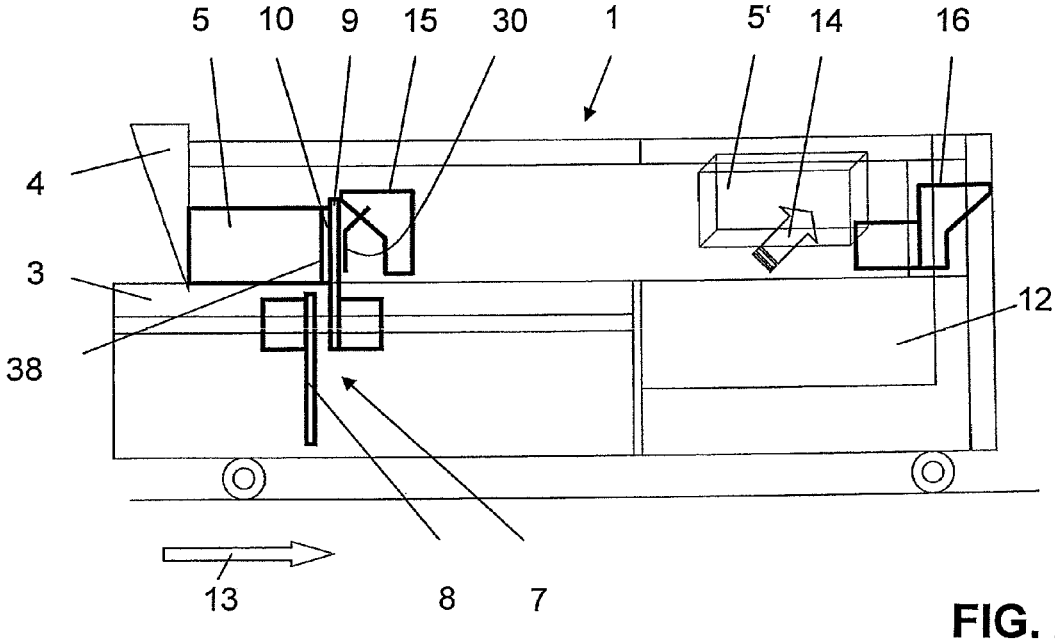

With the method step shown in FIG. 2, the compressed and strapped stack 5' is in the process of being transported to a further processing location, in the direction of arrow 14. In FIG. 2, the first compression carriage 15 that is now freed has already been moved to the left and toward the forming stack 5, while the second compression carriage 16 in its position at the right end of the device 1 is still blocked by the compressed and strapped stack 5'. In this situation, the supporting function of the stack 5 is still realized by the second support and separating element 9, which presses the first end plate 10 against the stack 5. The first support and separating element 8 has already been moved downward and is thus no longer in contact with the forming stack 5. Following this, the first compression carriage 15 that moves in the direction of the forming stack 5 extends through the second support and separating element 9, which can be embodied fork-shaped, and thus takes over the support of the stack 5 on the stack side 38. The second support and separating element 9 is provided with slots for this, not shown herein, through which the first compression carriage 15 can extend.

Since the stack 5 is now supported by the first compression carriage 15, the second support and separating element 9 is also freed up. The second support and separating element 9 is therefore initially moved downward and to the left and arrives together with the first support and separating element 8 in the position shown in FIG. 3. The two support and separating elements 8 and 9 in the process enter the stack 5 from below and portion off a following stack 5" that forms from the stack 5. This process of portioning off a stack 5" from the formed stack is disclosed in the art, for example, in European Patent Documents EP-A-0 623 542, EP-A-0 847 949 and EP-A-0 872 443.

Figure 3:
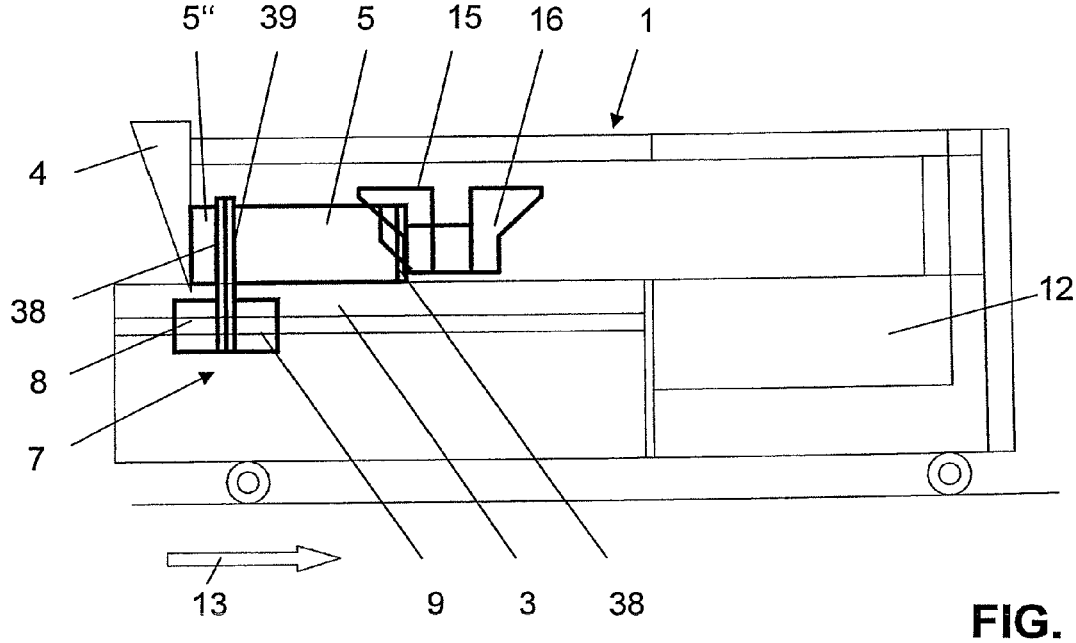
Figure 4:
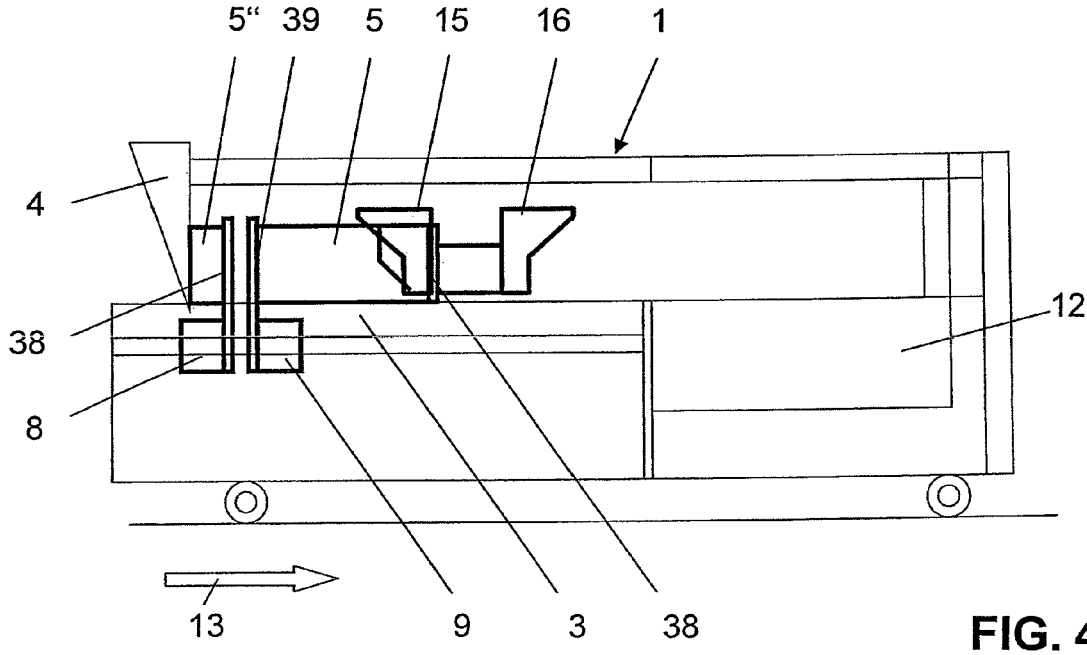
Figure 5:
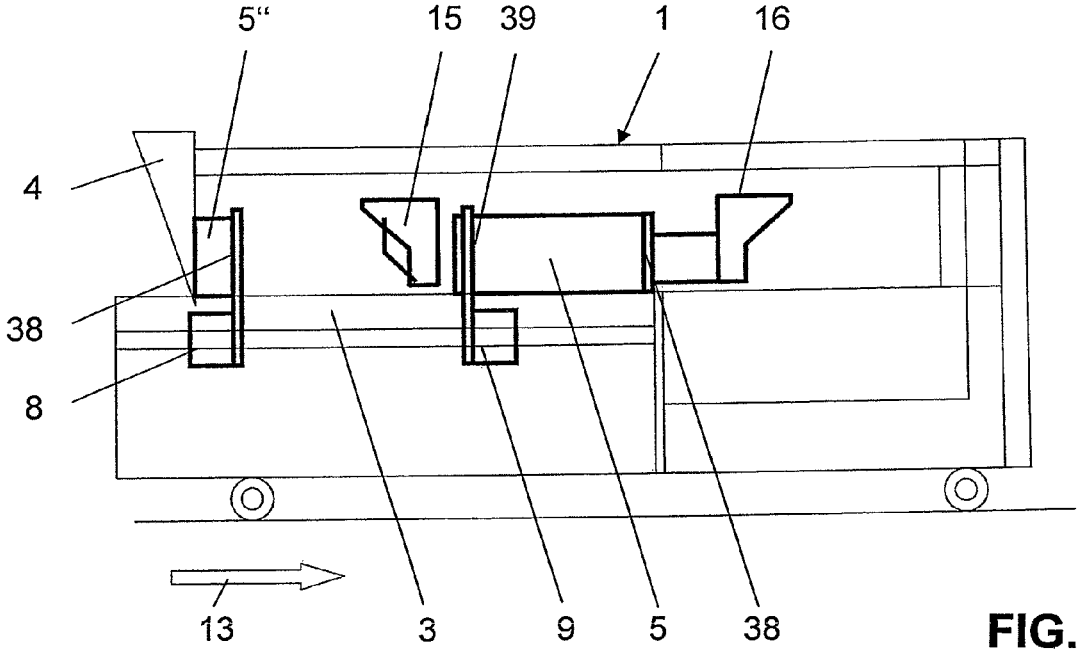
Figure 6:
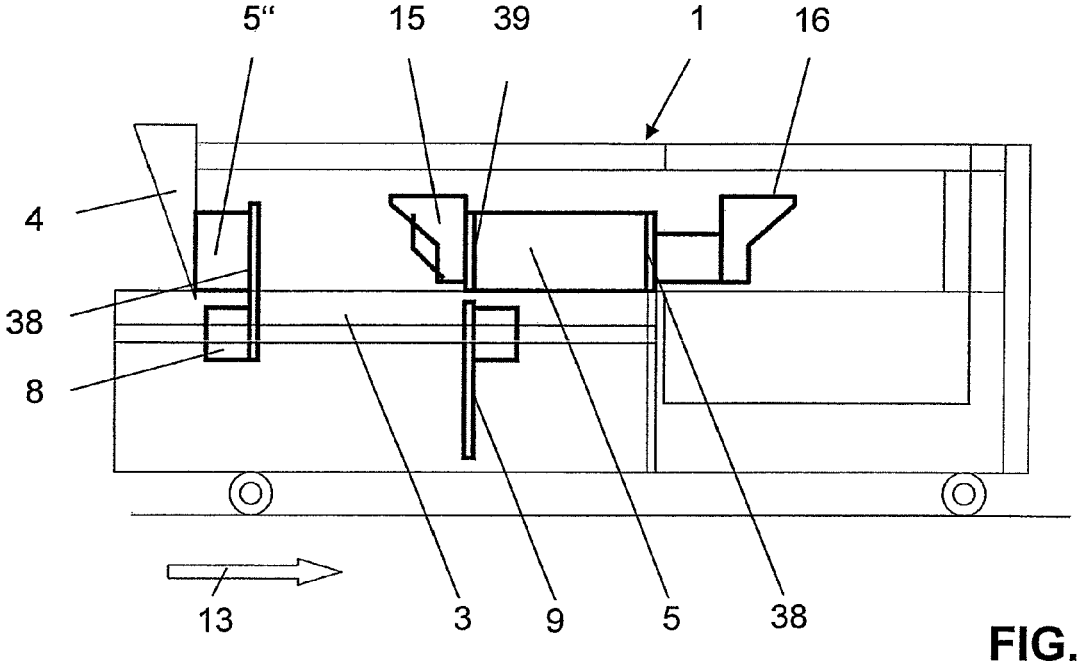
Figure 7:
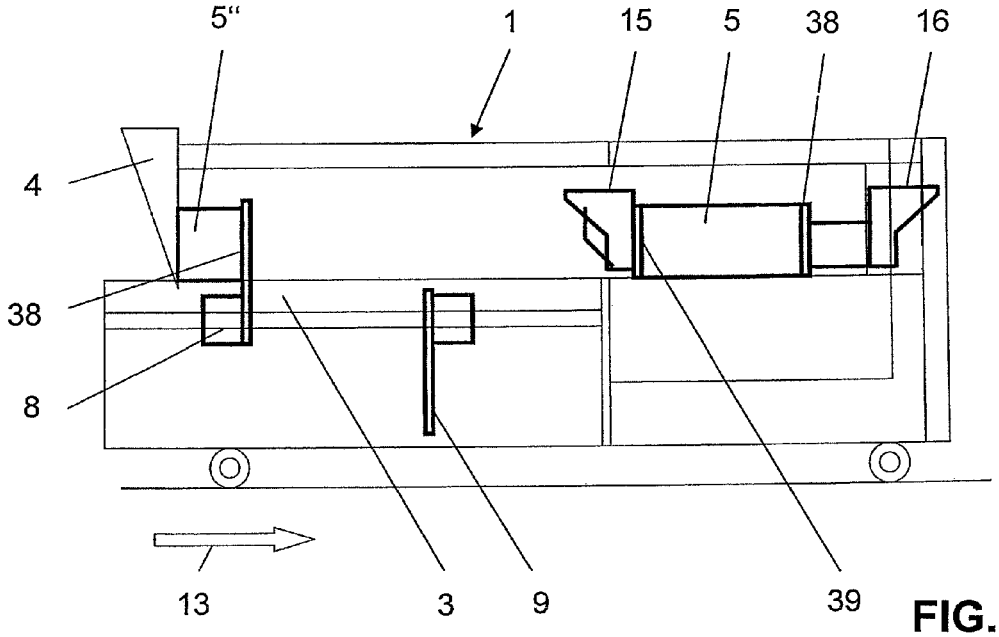

The second compression carriage 16, which is also freed up following the conveying away of the compressed and strapped stack 5', is then also moved to the left and finally takes over the supporting function of the first compression carriage 15, as shown in FIG. 3. The two support and separating elements 8 and 9 are subsequently moved apart, as shown in FIG. 4, so that the stack 5" can continue to form. The second separating element 9 and the second compression carriage 16 are then moved to the right, into the position shown in FIG. 5, wherein the second separating element 9 is guided through the essentially non-moving first compression carriage 15. Once the stack 5 which moves along has reached the position shown in FIG. 5, the first compression carriage 15 is moved up and takes over the supporting function of the second support and separating element 9 on the stack side 39 that is facing the conveyor 4. The second support and separating element 9 of the supporting device 7 is thus freed up and is moved to the position shown in FIG. 6. The two compression carriages 15 and 16 compress the stack 5 and move it to the position shown in FIG. 7, in which it is strapped. The second separating element 9 is at the same time moved once more to the position shown in FIG. 1. The illustrated sequence of method steps can then be repeated with the following stack 5".

Figure 8:
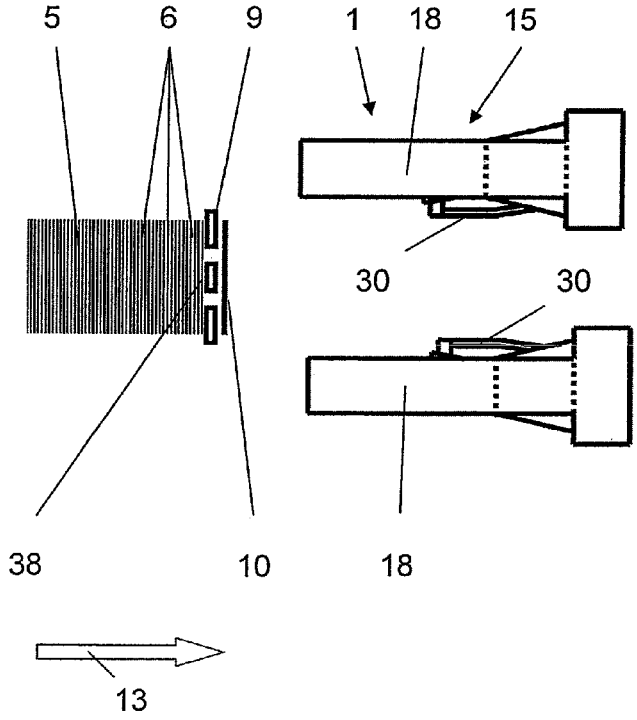
FIGS. 8-18 are schematic views from above of parts of the device according to the invention during different phases of a processing cycle.
Figure 19:
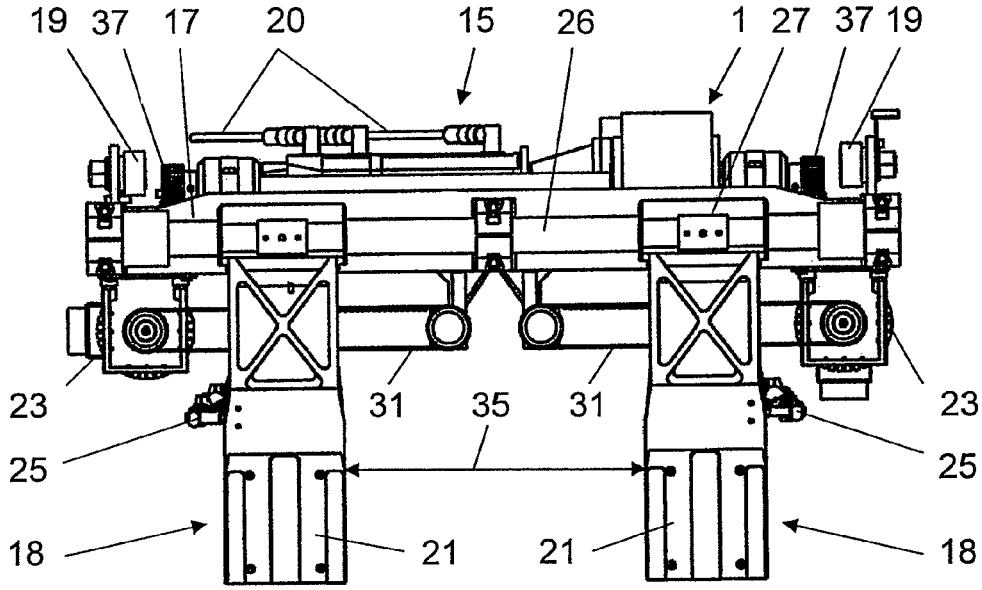
FIG. 19 is a view of the first compression carriage.
Figure 20:
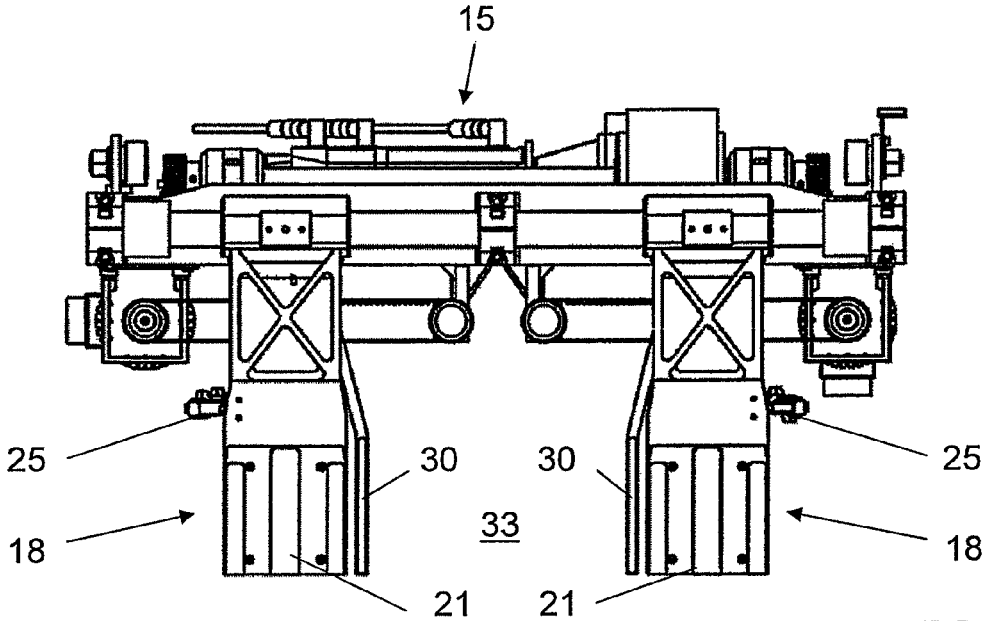
FIG. 20 is an alternative view of the first compression carriage.

For a better understanding, the method sequences in FIGS. 8 to 18 are shown in a view from above of parts of the device 1. FIG. 8 only shows two spaced apart compression members 18 of the first compression carriage 15, wherein these members can essentially be embodied identical and can extend in stack conveying direction 13. Each compression element 18 comprises a compression jaw 21 (FIGS. 19, 20) with a thereon arranged movable support element 30.

Figure 9:
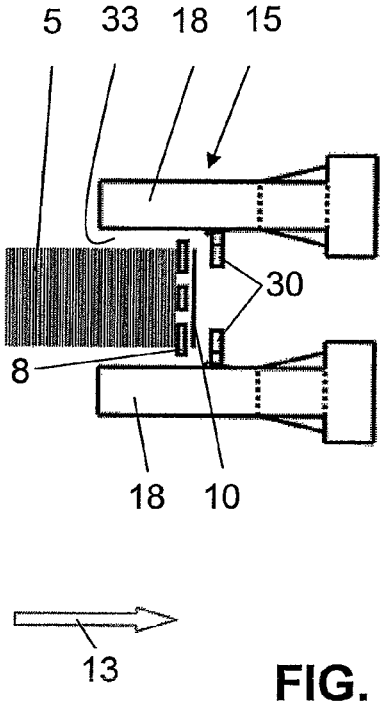
Figure 10:
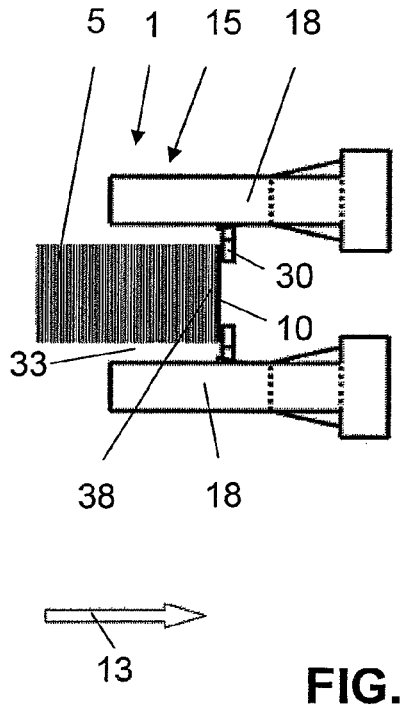

In FIG. 9, the forming stack 5 is supported by the first support and separating element 8. Following this, the first end plate 10 together with the second support and separating element 9, not shown herein, is moved against the stack 5, so that the first support and separating element 8 can be removed. FIG. 10 shows the device 1 during a subsequent method step in which the stack 5 is supported by the first compression carriage 15 on the stack side 38 that is facing away from the conveyor 4, wherein the two support elements 30 are respectively fitted against the first end plate 10. The stack 5 in this case is located partially in an intermediate space 33 between the two compression members 18.

Figure 11:
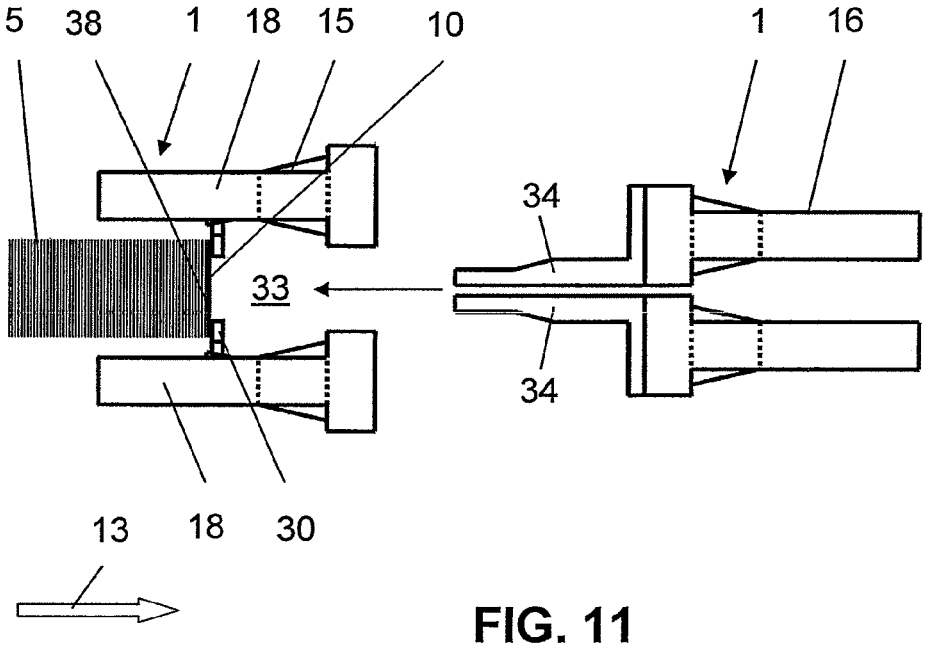
Figure 12:
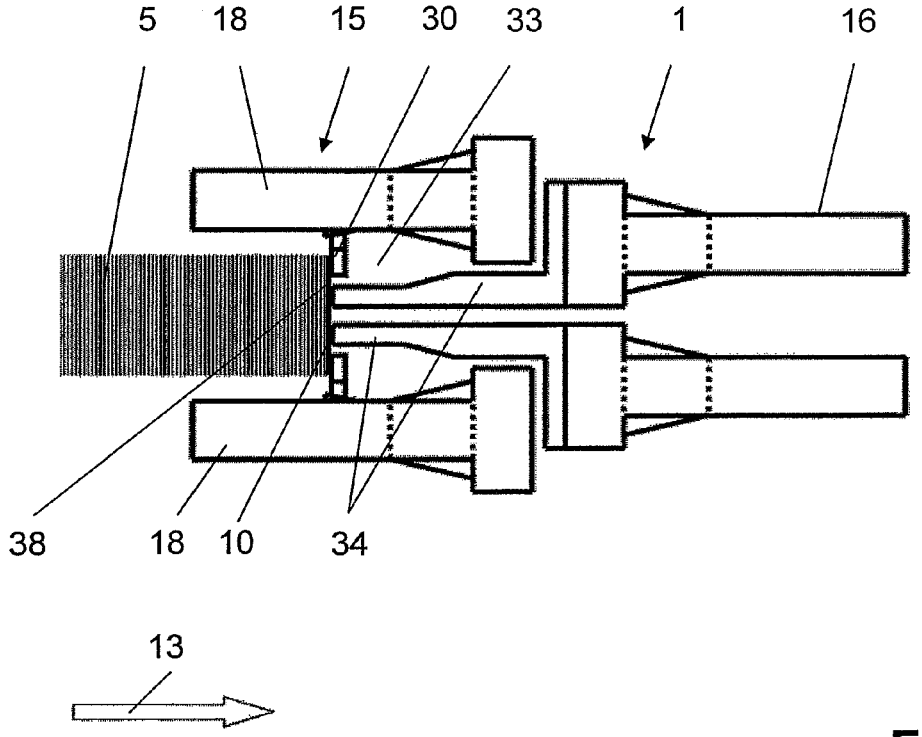
Figure 13:
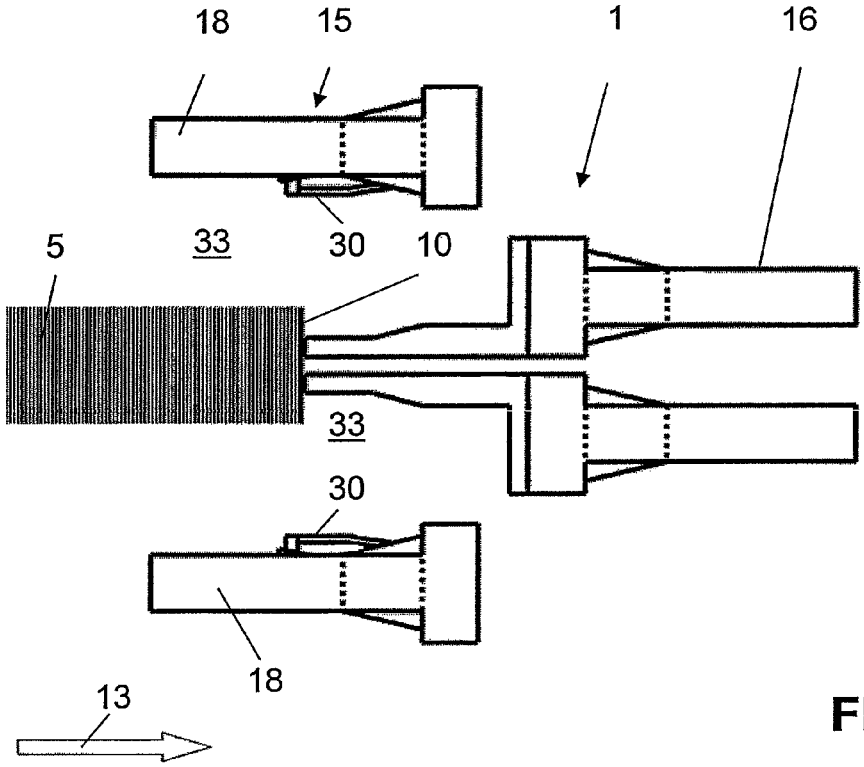

FIG. 11 shows the movement of the second compression carriage 16 toward the stack 5. Two jaws 34 of the second compression carriage 16 move into the intermediate space 33 between the two compression members 18 and into the position shown in FIG. 12. The two jaws 34 then fit with a front end against the first end plate 10 and support this end plate, thereby causing the stack 5 to be supported on the stack side 38 by the second compression carriage 16. The two compression members 18 of the first compression carriage 15 are then moved apart in a direction transverse to the stack conveying direction 13. The two support elements 30 are simultaneously moved to the pulled-back position shown in FIG. 13, wherein the movement can be a swiveling movement, a pushing movement, or another type of movement. As can be seen, the support elements 30 in this pulled-back position do not restrict the intermediate space 33 between the compression members 18. The intermediate space 33 is thus clear to allow passage of the stack 5 in conveying direction 13, wherein the stack 5 could also be considerably wider than is shown in FIG. 13.

Figure 14:
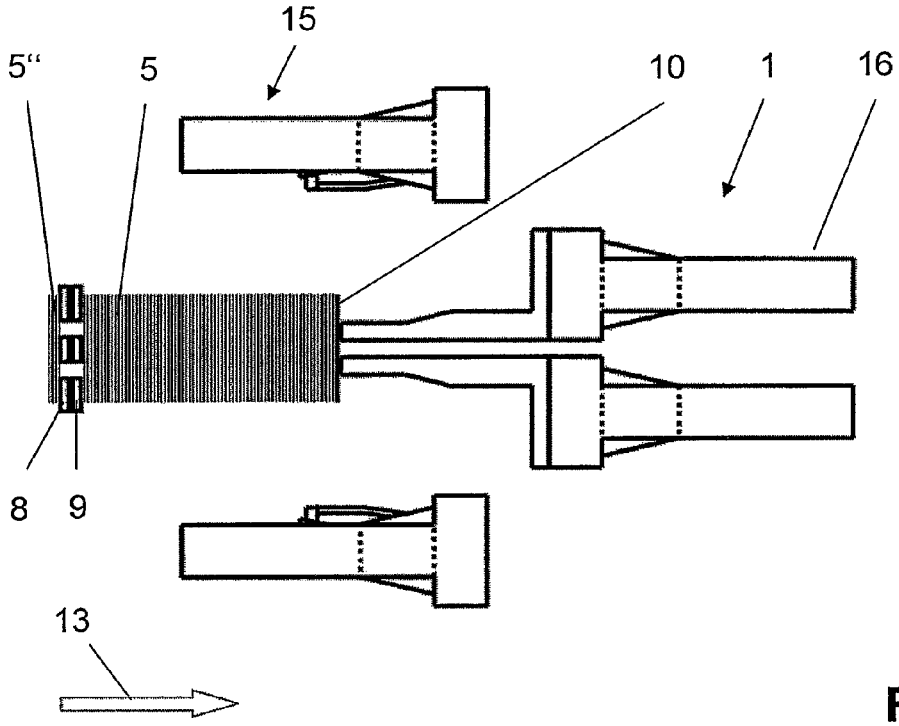
Figure 15:
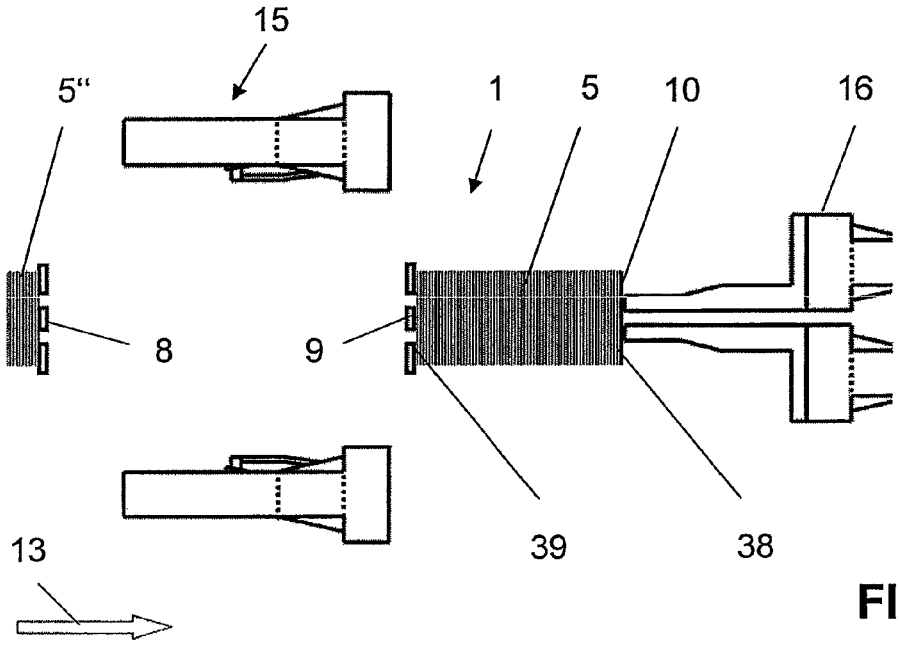
Figure 16:
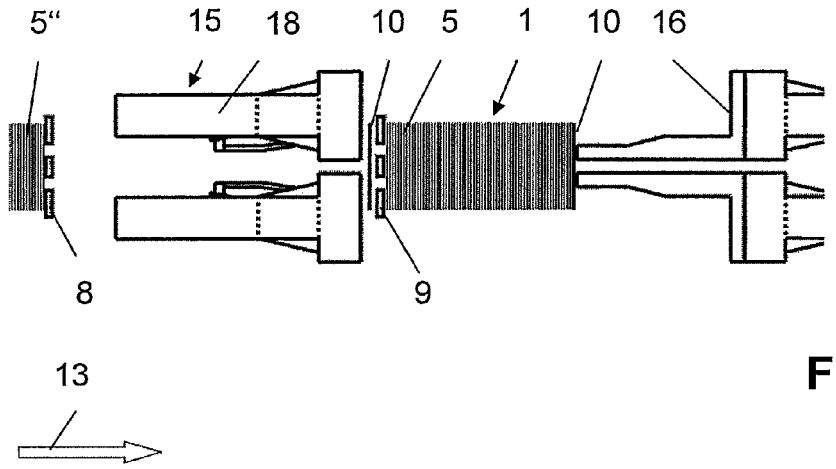
Figure 17:
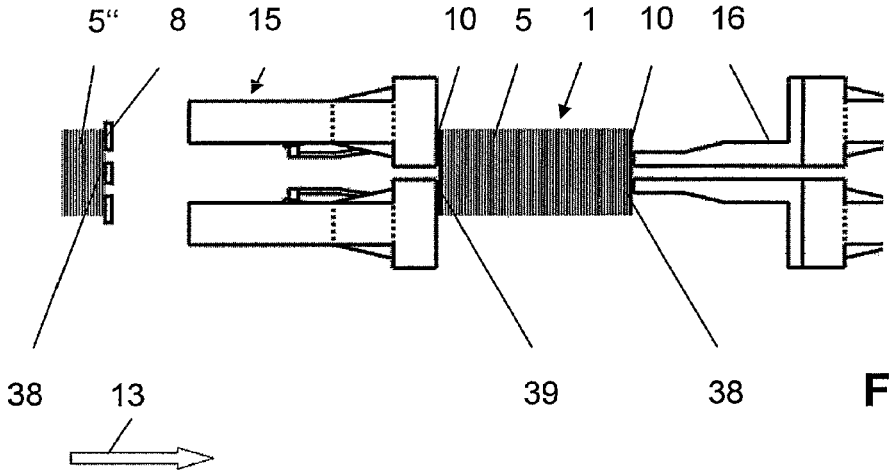
Figure 18:
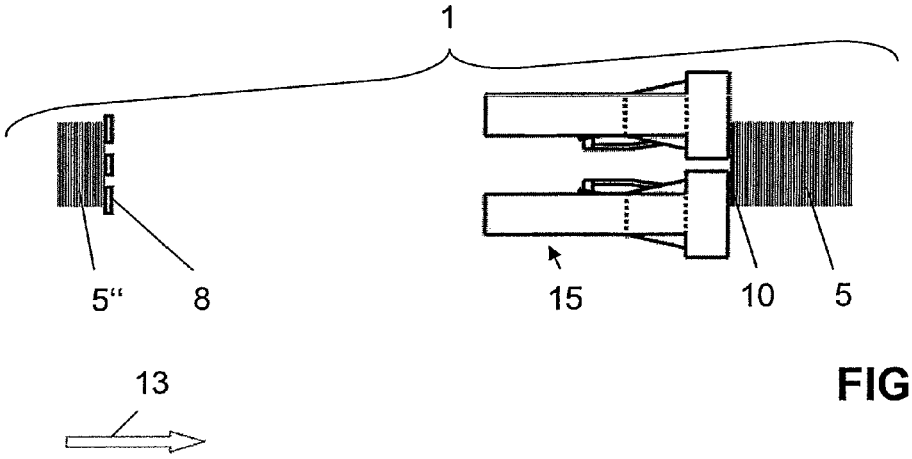

FIGS. 14 and 15 show the stack 5, previously separated from the stack 5" with the aid of the support and separating elements 8, 9, during the movement in stack conveying direction 13, meaning in the direction of the strapping device 12. The stack 5 in the process is supported on the stack side 39 by the second support and separating element 9 and on the stack side 38 by the second compression carriage 16. The support and separating element 8 supports the stack 5" that forms. FIGS. 16 and 17 show the subsequent movement of the first compression carriage 15 in a supporting position, in which it fits against the stack side 39, so that the second support and separating element 9 can be moved downward and away. FIG. 18, which corresponds to FIG. 7, finally shows the stack 5 in the region of the strapping device 12.

With the aid of FIGS. 19 to 22, the first compression carriage 15 is explained in further detail in the following.

The first compression carriage 15 comprises a frame 17 on which four guide rollers 19 are attached for moving the first compression carriage 15 along rails that are not shown herein. Furthermore attached to the frame 17 is a transverse extending axis 26, on which the two compression members 18 are each displaceable, for example, with the aid of a bearing 27. The compression members 18 can respectively be moved with a motor 23 and an endless drive element 31 along the axis 26 for changing the spacing 35, shown in FIG. 19. The spacing 35 between the compression members 18 can thus be reduced or increased, thereby making it possible to adapt to different stack widths. As a result, extremely narrow as well as extremely wide stacks can be processed. Wide stacks 5, for example, are stacks which have a dual use.

Figure 21:
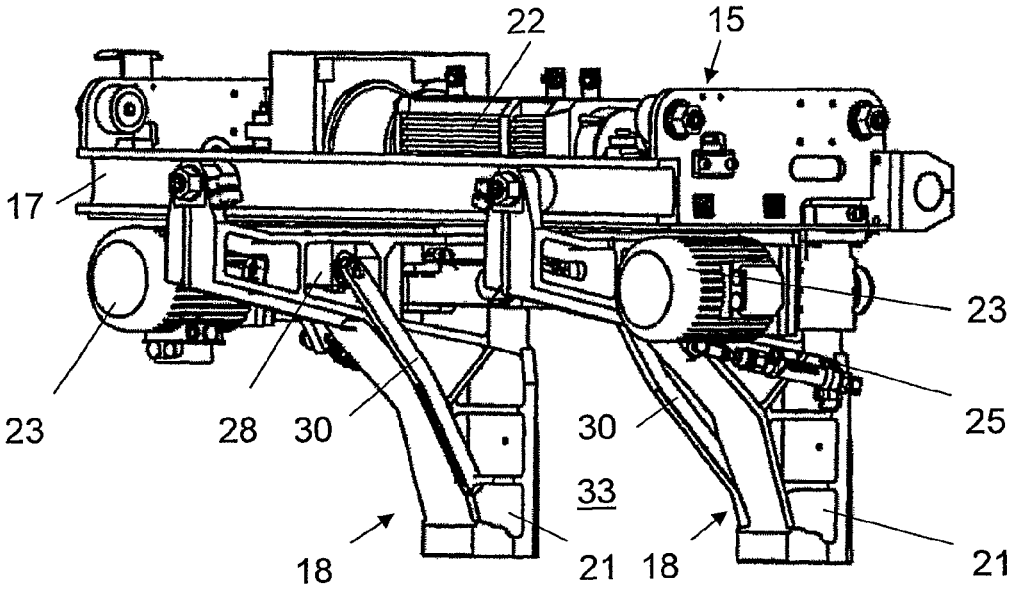
FIG. 21 is a three-dimensional view of the first compression carriage.
Figure 22:
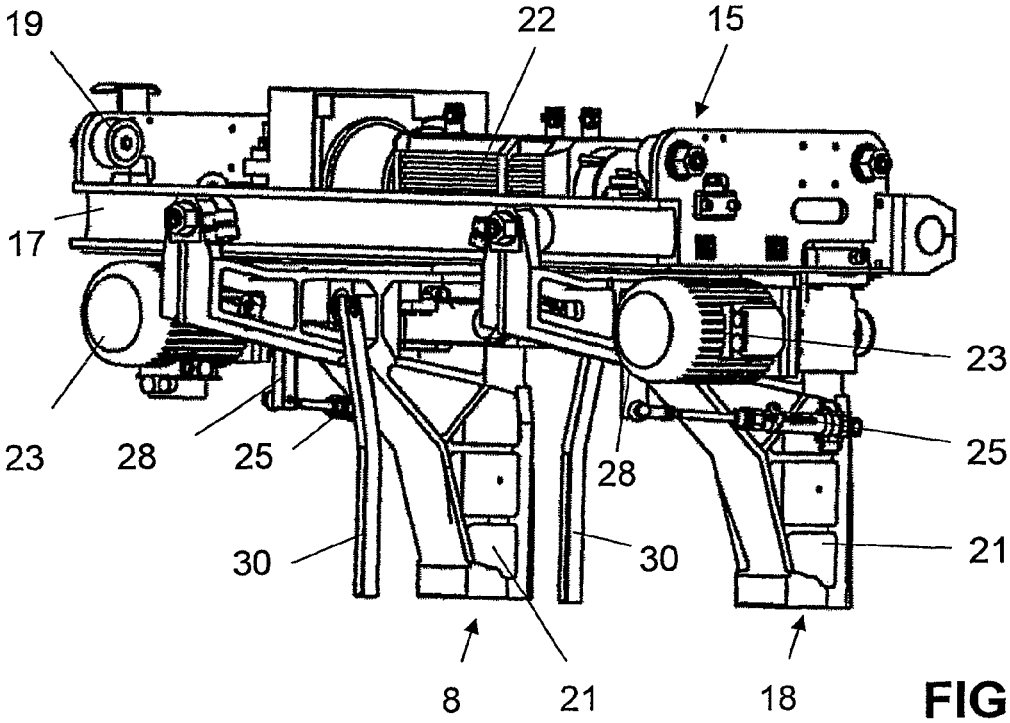
FIG. 22 is an alternative three-dimensional view of the first compression carriage.

An additional motor 22 for generating the pressing force required for compressing a stack 5 is mounted on the frame 17 (FIG. 21). The motor 22 operates the steering racks, not shown herein, via two toothed gears 37 (FIG. 19), wherein a different force transmission is of course also conceivable. The motor 22 is supplied with electrical power via cables 20. Also provided are pneumatic and electrical connections, not shown herein, and a connection for a control unit that is not shown herein.

Figure 23:
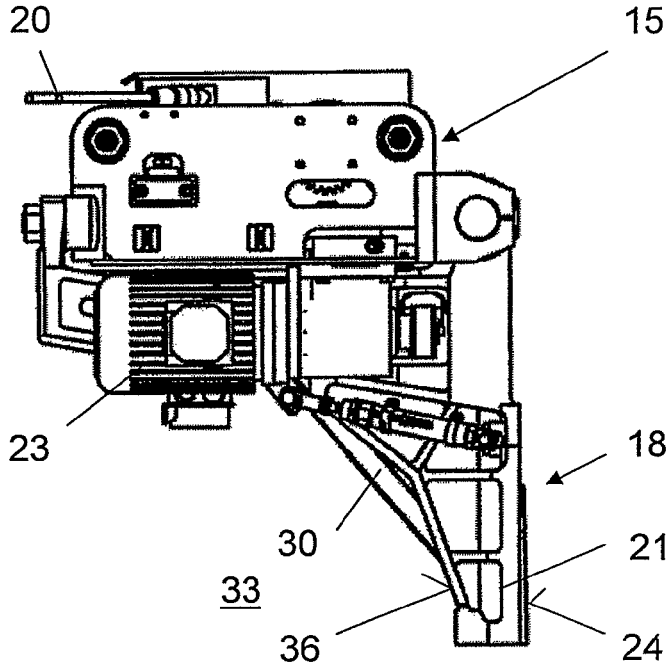
FIGS. 23, 24 are additional views of the first compression carriage.
Figure 24:
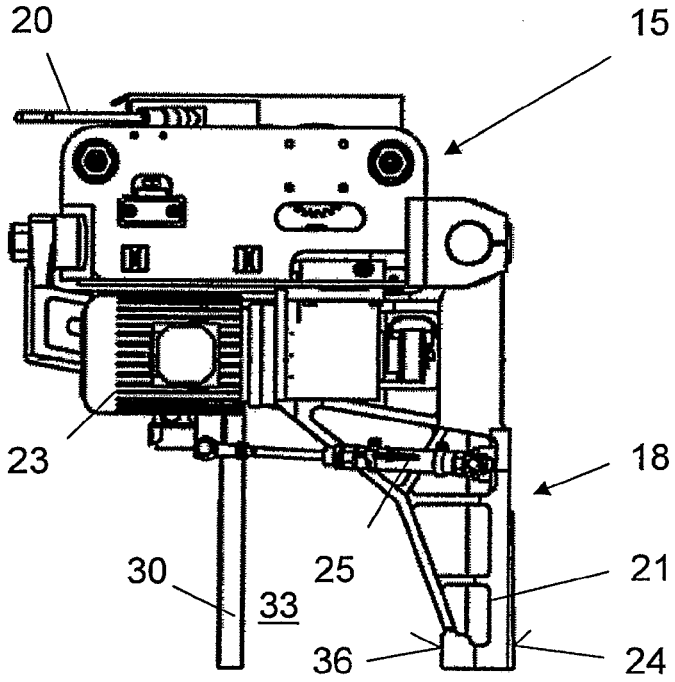

A separate support element 30 is arranged on each compression member 18 and is embodied rod-shaped or yoke-shaped. The support elements 30 are respectively positioned pivoting via a rod assembly 28 (FIG. 22) on an upper end of a compression jaw 21. Each support element 30 is connected via the rod assembly 28 to a pneumatic positioning cylinder 25 that is attached to the respective compression jaw 21. By activating the positioning cylinder 25, the support elements 30 can be moved between an outer, pulled-back position shown in FIGS. 19, 21 and 23 and an inner, operating position shown in the FIGS. 20, 22 and 24. In the operating position, the support elements project into the intermediate space 33 between the two compression jaws 21. The control unit, not shown herein, thus controls the movement of the support elements 30 which is caused by the positioning cylinders 25. In the pulled-back position, the support elements 30 are arranged behind the compression jaws 21, so that they do not restrict the intermediate space 33 and the maximum width is available for the passage of the stack 5. Even comparatively wide stacks 5 can thus be guided through the first compression carriage 15 without the danger of collision. As shown in particular in FIG. 24, the support elements 30 are located on a side 36 of the compression jaws 21 that is facing the conveyor 4 and thus on the compression carriage 15. The back sides 24 of the compression jaws 21 form a surface used to compress the stack 5.

In the embodiment shown, the support elements 30 are downward-facing yokes. However, they can also be embodied in the shape of a platform and can be positioned to be displaceable to the side. In principle, the support elements 30 can also be embodied as non-movable areas on the side 36 of the compression jaws 21, which faces the conveyor 4. It is advantageous that the support elements 30 are embodied such that they can take over the function to support a forming stack 5, 5" until the second compression carriage 16 is available to take over this function. Besides the standard compression function, the first compression carriage 15 can thus advantageously also take on a supporting function. The support elements 30 can be realized with comparatively low structural expenditure, so that no substantially higher production costs accrue. Nevertheless, the cycle time can be reduced considerably.

Owing to the fact that following the compressing and, if applicable, also the strapping of a stack, regardless of its length, the second compression carriage 16 may wait until the finished stack is discharged before it can be moved counter to the stack conveying direction 13 to support the newly forming stack, the time saving or the increased capacity is particularly high for comparatively short stacks 5 when using the method according to the invention and the corresponding device.

It will be understood that the above description of the present invention is susceptible to various modifications, changes and adaptations, and that the same are intended to be comprehended within the meaning and range of equivalents of the appended claims.

What is claimed is:

1. A device for producing stacks of printed sheets, comprising:

a conveyor that conveys printed sheets;

a horizontally extending stack support that receives the printed sheets from the conveyor supplied continuously in an upright position;

a supporting device that forms a stack on the stack support, wherein the stack includes a first end positioned towards the conveyor and a second end positioned away from the conveyor; and a compression device that receives and compresses a completed stack from the supporting device, wherein the compression device comprises a first compression carriage and a second compression carriage between which a completed stack is compressed, and wherein the first compression carriage is adaptable to fit the second end of the stack to be compressed and includes at least one support element to support a forming stack on the second end.

2. The device according to claim 1, wherein the at least one support element is movable.

3. The device according to claim 2, wherein the at least one support element is moveable between an inner position and an outer position.

4. The device according to claim 1, wherein the first compression carriage includes at least two support elements that are moveable between an inner position and an outer position.

5. The device according to claim 3, wherein the at least one support element comprises a pivoting yoke.

6. The device according to claim 1, wherein the first compression carriage includes two compression members that move transverse to the horizontally extending stack support.

7. The device according to claim 6, wherein the at least one support element is arranged on at least one of the two compression members.

8. The device according to claim 1, wherein the at least one support element is arranged on a side of the first compression carriage facing the conveyor.

* * * * *